US010113274B2

(12) United States Patent
Caputo

(10) Patent No.: US 10,113,274 B2
(45) **Date of Patent: *Oct. 30, 2018**

(54) ROAD FINISHER WITH HEATED TAMPER BAR

(71) Applicant: BOMAG GMBH, Boppard (DE)

(72) Inventor: Gianluca Caputo, Castenaso (IT)

(73) Assignee: BOMAG GMBH, Boppard (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/355,775

(22) Filed: Nov. 18, 2016

(65) Prior Publication Data

US 2017/0138002 A1 May 18, 2017

(30) Foreign Application Priority Data

Nov. 18, 2015 (EP) ..... 15003291

(51) Int. Cl.
*E01C 23/14* (2006.01)
*E01C 19/40* (2006.01)
(Continued)

(52) U.S. Cl.
CPC ..... *E01C 19/405* (2013.01); *C23C 4/06* (2013.01); *C23C 4/10* (2013.01); *C23C 4/126* (2016.01); *C23C 4/134* (2016.01); *E01C 19/34* (2013.01); *E01C 19/4833* (2013.01); *E01C 23/14* (2013.01); *E01C 19/40* (2013.01); *E01C 19/486* (2013.01); *E01C 2301/10* (2013.01)

(58) Field of Classification Search
CPC ..... E01C 19/30; E01C 19/40; E01C 19/405; E01C 23/14
USPC ..... 404/95, 114, 118
See application file for complete search history.

(56) References Cited

U.S. PATENT DOCUMENTS 6,124,580 A * 9/2000 Nottmeier ..... E01C 19/407 219/618
7,427,174 B2 * 9/2008 Dearing ..... E01C 19/407 404/118

(Continued)

FOREIGN PATENT DOCUMENTS

DE 9313161 10/1993
EP 2599919 6/2013

OTHER PUBLICATIONS

Office Action from related U.S. Appl. No. 15/355,662 dated Aug. 1, 2017.

*Primary Examiner* — Gary S Hartmann
(74) *Attorney, Agent, or Firm* — Grossman, Tucker, Perreault & Pfleger, PLLC

(57) ABSTRACT

A road finisher comprising a screed plate extending at right angles to the working direction of the road finisher, and a tamper bar disposed rearwardly and/or forwardly of the screed plate in the working direction, wherein at least one electrically operated heating element is present, which is configured so as to heat up a heating surface facing a road subsurface, and wherein the heating element comprises a heating layer at least partially obtained through thermal spraying onto a substrate surface, wherein the tamper bar is made from two parts with an upper tamper bar member and a lower tamper bar member assembled together. Further, a tamper bar for a road finisher and a method of manufacturing a tamper bar are provided.

11 Claims, 5 Drawing Sheets

(51) Int. Cl.

| | |
|---|---|
| ***C23C 4/126*** | (2016.01) |
| ***C23C 4/134*** | (2016.01) |
| ***C23C 4/06*** | (2016.01) |
| ***C23C 4/10*** | (2016.01) |
| ***E01C 19/34*** | (2006.01) |
| ***E01C 19/48*** | (2006.01) |

(56) References Cited

U.S. PATENT DOCUMENTS

| | | | | |
|---|---|---|---|---|
| 8,113,738 | B2 * | 2/2012 | Mahler | E01C 19/407<br>404/118 |
| 9,249,544 | B2 * | 2/2016 | Caputo | E01C 19/4833 |
| 9,988,771 | B2 * | 6/2018 | Caputo | C23C 4/126 |
| 2011/0002738 | A1 | 1/2011 | Mahler et al. | |
| 2015/0037097 | A1 | 2/2015 | Caputo | |
| 2017/0138001 | A1 * | 5/2017 | Caputo | C23C 4/126 |

* cited by examiner

ROAD FINISHER WITH HEATED TAMPER BAR

FIELD

The present invention generally relates to a road finisher comprising a screed plate and a tamper bar, the tamper bar comprising a heating element, and more particularly, relates to a tamper bar for a road finisher and a method of manufacturing a tamper bar comprising a heating element.

BACKGROUND

Road finishers or asphalt finishers are construction machines for producing asphalt surfaces, also known as pavers. In operation, the road finisher distributes and smoothes bituminous paving material, and may also compact the same. For this, the road finisher basically is equipped with a screed plate for smoothing the paving material, and a tamper bar for precompacting the paving material before it is smoothed. In order to prevent sticking of the bituminous paving material to the paving device, heating devices are employed which heat up the tamper bar and/or the screed plate and which may be implemented on the tamper bar and/or the screed plate, for example, as a multi-layered structure of heating layers applied by thermal spraying.

US 2015/0037097 A1 discloses a road finisher comprising a screed plate and/or tamper bar wherein a heating layer is applied to the screed plate and/or tamper bar by thermal spraying.

However, the solutions known from prior art for heating the tamper bar on the one hand are rather expensive, and on the other hand, require a rather complex production procedure. Since the tamper bar with its tamping surface is subject to high stress, it usually has to be replaced after a certain operating period and thus, together with it, the entire heating device connected thereto has to be replaced too, thus increasing the maintenance costs of the road finisher.

Also, it is only possible to arrange the heating device or to apply the heating layers into a corresponding recess on the backside of the tamper bar opposite to the tamping surface in order to avoid damage or even destruction of the heating device during operation, when the tamping surface hits the ground with high pressure. Thus, the positioning possibilities of the heating device are restricted, since it requires a protected area, whereby possibly even additional protection means may have to be provided. The restricted freedom of positioning may cause, for example, an adverse non-uniform heating-distribution or the generation of hot points next to the contact surfaces as well as rather long heating-up times until the tamper bar has reached the desired operating temperature. Finally, with the known arrangements of heating devices at tamper bars of a road finisher, also high material costs are created, since the entire tamper bar has to consist of a heat-treated material.

SUMMARY

Therefore, it is an object of the present invention to provide a more cost efficient solution of a heated tamper bar for a road finisher. This object is solved by a road finisher having the features according to claim 1, a tamper bar for a road finisher having the features according to claim 12, and a method of manufacturing a tamper bar having the features according to claim 13. Further embodiments of the invention are defined in the respective dependent claims.

According to the invention, a road finisher is provided, comprising a screed plate extending at right angles to the working direction of said road finisher, and a tamper bar disposed rearwardly and/or forwardly of said screed plate in the working direction, wherein at least one electrically operated heating element is present, which is configured so as to heat up a heating surface facing a road subsurface, and wherein said heating element comprises a heating layer at least partially obtained through thermal spraying onto a substrate surface, wherein the tamper bar is made from two parts with an upper tamper bar member and a lower tamper bar member assembled together.

Thus, due to the inventive configuration according to which the tamper bar is made from two parts, only the lower tamper bar functions as the actual tamper device which hits or contacts with its lower surface the ground during the tamping action, and thus is subject to high stress and therefore, strong wear. Thus, the expensive material adapted for withstanding such conditions, as specifically hardened metal, e.g., hardened steel, only has to be used for this lower part and not for the entire tamper bar, thereby saving material costs. Moreover, if, after a certain operation time, wear renders the lower tamper bar unusable, only this part has to be replaced and not the entire tamper bar. A further advantage of the inventive configuration according to which the tamper bar is split into two parts is that the heating element may be applied to either one of the lower surface of the upper tamper bar or the upper surface of the lower tamper bar which actually, after assembling the upper tamper bar to the lower tamper bar, provides a protected space for the heating element where it neither is exposed to high stress nor may it be damaged when positioned sandwiched inbetween the two tamper bar members. This configuration facilitates the production procedure and therefore, reduces production costs. Also, another advantage specifically when applying the heating element to the lower surface of the upper tamper bar is that when the lower tamper bar has to be replaced due to wear, then the heating element being provided on the upper tamper bar does not have to be replaced, too, thereby saving further maintenance costs. The tamper bar is usually a primarily longitudinally extending, beam-like element that is connected to a drive means, for example through a rod being connected to a tamper bar drive such as a driven shaft with an eccentric connecting means. Usually, the tamper bar extends along the width of a screed unit. It is however alternatively possible, that a plurality of tamper bars, being arranged side by side, extend together along the width of the screed unit.

Moreover, it is noted that by using thermal spraying which is defined as a standard in DIN EN 657, the surface to be coated can be coated directly without the need to provide a specifically processed cavity or hole for the heating element which has to be produced by expensive and complex procedures or to apply the heating element by adhesive bonding. Moreover, a heating layer obtained by thermal spraying provides the advantage of being extremely resistant against mechanical stress and allows for optimized heat transfer to the tamper bar. As a result of the implementation of such a heating element having a heating layer obtained by thermal spraying, the initial heating phase can be reduced considerably, which in turn results in reduced fuel consumption and an increased efficiency of the road finisher. Additionally, a heating layer applied by thermal spraying can be easily applied to any structured surface, even to angled structures.

It is noted that the term "heating layer" functionally refers to a coating by means of which a heating effect can be achieved. To this end, the heating layer is connected by suitable connecting means to the power source and can be switched on and off by means of a switch gear unit. The term "heating element" refers to the entire unit consisting of the heating layer and its connections to the power source.

According to an advantageous embodiment of the invention, the upper tamper bar member has a lower surface which, in the assembled state, contacts an upper surface of the lower tamper bar member, wherein a groove is provided in either one of the lower surface of the upper tamper bar member or the upper surface of the lower tamper bar member. The groove may advantageously be used for applying the heating layer of the heating element so that after assembling the upper tamper bar and the lower tamper bar the heating element is accommodated in an enclosed and thus protected area. The groove thus denotes a depression in the upper surface of the lower tamper bar member and/or in the lower surface of the upper tamper bar, for example obtained via cutting and/or milling. Alternatively, the groove may be used to cover the heating element being applied to the opposite element of the tamper bar. In this case, the groove provides a reception space for accommodating the heating element being connected to the opposite tamper bar element. The key aspect of these embodiments is that the heating layer is buried and thus protected between the upper and lower tamper bar element.

According to a further preferred embodiment, the heating layer is multilayered comprising at least an insulating layer, a strip conductor and a sealing layer. This heating layer is preferably accommodated in the groove, especially without protruding over the surface surrounding the groove. The strip conductor is the layer that is connected to the power source and that heats up when electric current is applied thereto. The sealing layer, by contrast, performs a protective function for the strip conductor and shields the same from the environment on that side of the heating element being opposite to and facing away from the respective tamper bar member. The insulation layer electrically insulates the strip conductor, through which an electric current flows during the heating operation from the tamper bar. To this end, the insulating layer is located between the respective tamper bar member and the strip conductor. It is furthermore possible that the heating layer additionally comprises a further anchor layer between the insulating layer and the tamper bar element.

Further, the heating layer may be applied to a surface of the groove in the upper tamper bar member or it may be applied to a surface of the groove in the lower tamper bar member at least partially and preferably completely by plasma spraying or high velocity oxygen fuel spraying (HVOF). Both plasma spraying and HVOF are examples for a preferred thermal spraying method. These thermal spraying techniques are coating processes in which molten (or heated) materials are sprayed onto a surface. The "feedstock" (coating precursor) is heated by electrical (plasma or arc) or chemical means (combustion flame). A spray torch (or spray gun) is the device performing the melting and acceleration of the particles to be deposited. Plasma spraying, as a subgroup of the thermal spraying methods, is characterized by causing melting to be effected by the high plasma temperature or a gas or gas mixture passing through the plasma torch, which gas or gas mixture has been guided through an arc and ionized. When hitting the surface to be coated, the particles flatten and harden, thus forming a very stable layer of a desired thickness on the surface to be coated.

The groove, in the assembled state of the upper tamper bar member and the lower tamper bar member, may provide an encapsulated cavity for the heating layer. The thus provided cavity offers optimal protection for the heating element so as to ensure a long lifetime of the latter.

According to still another embodiment, the upper tamper bar member forms an intermediate part or spacer between a piston rod connected to an upper surface of the upper tamper bar member and the lower tamper bar member.

The upper tamper bar member and/or the lower tamper bar member is/are made from steel, and wherein especially the lower tamper bar is made from hardened steel. Due to the two-piece structure of the tamper bar, only the lower tamper bar has to be made from the more expensive hardened steel, whereas for the upper tamper bar, a more economical material may be used.

Moreover, at least said insulating layer and/or said sealing layer may be made from an alumina based material, preferably, from alumina with a purity of at least 99.7%.

The strip conductor may consist substantially of nickel, chromium, or an alloy including both nickel and chromium.

According to still a further embodiment of the invention, electrical connections of the heating element are provided on the upper surface of the upper tamper bar member, preferably, in a casing where they are protected from external influences.

It is also advantageous, if the upper tamper bar member is connected to the lower tamper bar member by fixation means, preferably, by screws or bolts. The use of screws and bolts enables an easy and fast assembling of the two tamper bar components.

Moreover, a tamper bar for a road finisher according to the above listed embodiments is provided according to the present invention. The tamper bar which basically is subdivided into a lower tamper bar member and an upper tamper bar member offers the advantages already described above.

Also, according to the invention, a method of manufacturing a tamper bar is provided, comprising the following steps of forming an upper tamper bar member, forming a lower tamper bar member, forming a groove in either one of an upper surface of the lower tamper bar member or a lower surface of the upper tamper bar member, applying a heating layer of a heating element to a surface of the groove via thermal spraying, and assembling the lower tamper bar member and the upper tamper bar member so as to form the tamper bar. The method for manufacturing a tamper bar is very economical, since the heating member, after the assembly of the upper tamper bar member and the lower tamper bar member, does not require any additional production steps for protecting it by additional protection means or the like. Also, the use of thermal spraying for the application of the heating element offers several advantages which already have been described above.

In the method of manufacturing a tamper bar, the heating layer may be multilayered comprising at least an insulating layer, a strip conductor and a sealing layer, wherein the step of applying the heating layer is performed by plasma spraying or HVOF.

In a embodiment of the invention, the upper tamper bar member and the lower tamper bar member are assembled by screwing the upper tamper bar member to the lower tamper bar member, and wherein the method further comprises a step of providing electrical connections in the upper tamper bar member for electrically connecting the heating element to a power source.

The present invention is described in greater detail below with reference to the exemplary embodiments shown in the figures.

DETAILED DESCRIPTION

Figure 1:
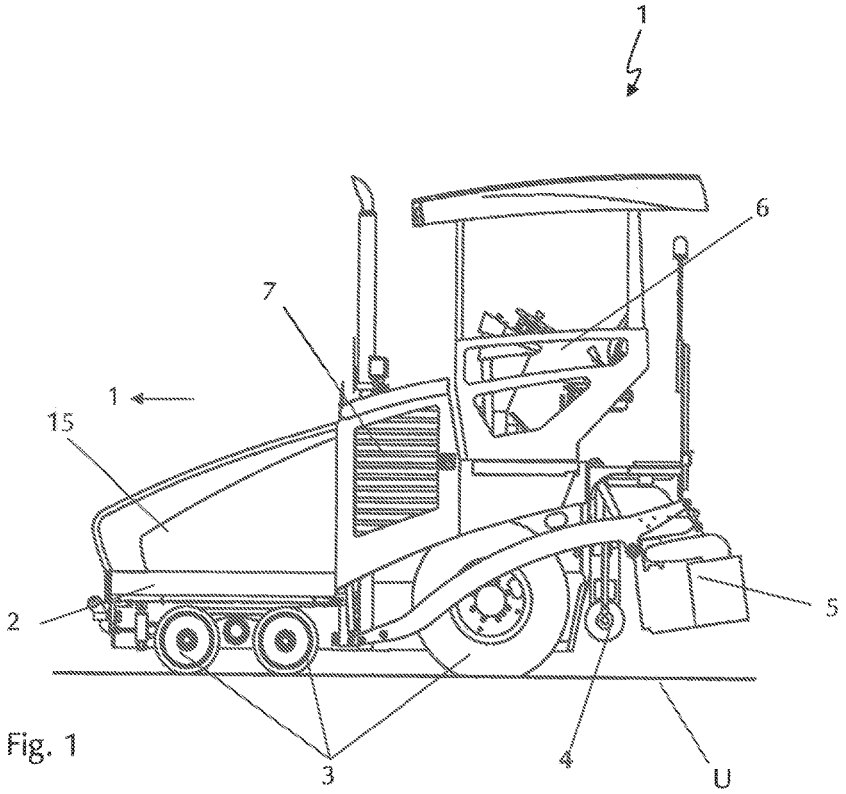
FIG. 1 is a side view of a road finisher.

As shown in FIG. 1, the essential components of the road finisher 1 are a machine frame 2, driving devices 3 for the traveling operation (track systems can also be used in this context, in part), a bunker 15 for accommodating paving material, a transporting unit (not shown in detail), by means of which the paving material accommodated in the bunker is transported rearwardly contrary to the working direction "a" to the paving section, a spreading screw 4, by means of which the paving material is distributed across the paving width of the road finisher 1 at right angles to the working direction "a", and a paving screed 5 that is trailed after the road finisher 1 during the paving operation in a floating manner on the bituminous paving material. The paving screed is mounted on the road finisher 1 so as to be vertically displaceable and can be lowered from its raised starting position towards the road subsurface for execution of the operating mode. Furthermore, a control platform 6 and a drive motor 7 are provided. In the operating mode, the road finisher 1 moves in the working direction "a" and deposits a layer of bituminous paving material of a desired thickness on the road subsurface for execution of the operating mode. Furthermore, a control platform 6 and a drive motor 7 are provided. In the operating mode, the road finisher 1 moves in the working direction "a" and deposits a layer of bituminous paving material of a desired thickness on the road subsurface "U".

Figure 2A:
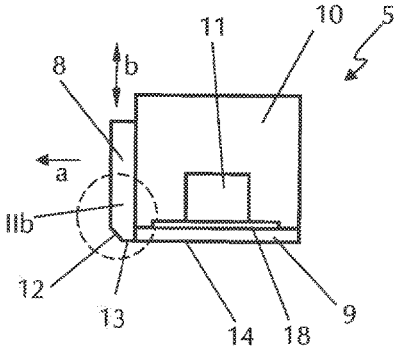
Fig. 2a (Prior Art)
FIG. 2*a* is a side view of a paving screed comprising a tamper bar and a screed plate according to prior art.

FIG. 2*a* illustrates the essential components of the paving screed. These include a tamper bar 8, a smoothing plate 9 disposed rearwardly of the same in the working direction "a", and a carrier housing 10 comprising an exciter unit 11. The carrier housing 10 and the smoothing plate 9 together form the screed plate. The tamper bar 8 is capable of being moved vertically in the direction of the arrow "b" and thus of carrying out stamping movements in the direction of the arrow "b" during the paving operation. In its front region, the tamper bar 8 comprises an obliquely extending guiding surface (lead-in slope 12) in the working direction followed by a horizontally extending tamping surface 13. The tamper bar 8 is followed by the smoothing plate 9. Above the smoothing plate 9 there is disposed an exciter unit 11 by means of which an oscillating movement can be induced in the paving screed 5. This basic structure of the paving screed 5 is known in the art. Further, the smoothing plate 9 comprises an underside 14 that slides over the paving material and levels the same during the operating mode. The smoothing plate 9 and the part having the lead-in slope 12 are each configured to have a first and a second heating layer 18, 18', respectively, as part of a heating element.

Figure 2B:
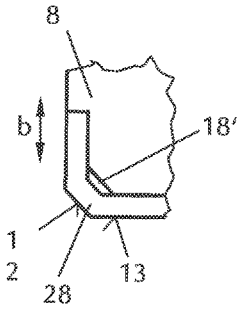
Fig. 2b (Prior Art)
FIG. 2*b* is an enlarged detail of the tamper bar according to prior art of FIG. 2*a;*

FIG. 2*b* illustrates the enlarged detail IIb of the tamper bar 8 as shown in FIG. 2*a* according to prior art. The tamper bar 8 has an L-steel rail 28 comprising a vertical and a horizontal leg and a part with the lead-in slope 12 connecting the two legs. The steel rail or metallic support plate 28 is covering the front edge of the tamper bar 8. On the back side of the part having lead-in slope 12 there is provided the second heating layer 18'. It is also possible to have a heating layer (not shown) on the back side of the horizontal and/or vertical leg of the tamper bar 8. The term "back side" in each case designates the outside surface facing away from the paving material. Thus, according to this configuration known from prior art, arrangement of the heating element is restricted to the back side of the tamper bar 8.

Figure 3:
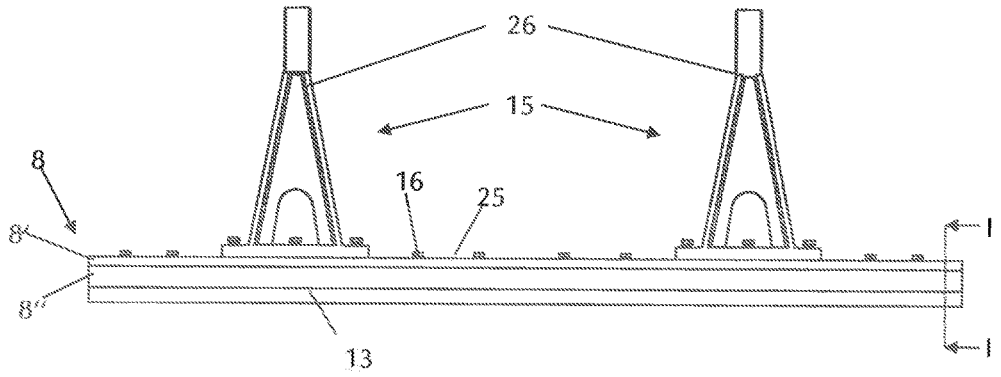
FIG. 3 is a perspective view of a piston rod and a tamper bar according to an embodiment of the invention.

FIG. 3 is a perspective view of a piston rod 15 and a tamper bar 8 according to an embodiment of the invention. As can be seen here, the tamper bar 8 comprises two parts, namely, an upper tamper bar member 8' and a lower tamper bar member 8". The lower tamper bar member 8" at its lower side comprises the tamping surface 13 which during operation contacts the ground and is subject to high stress and thus, strong wear. Therefore the lower tamper bar member 8" is made from hardened steel. The upper tamper bar member 8' which does not contact the ground surface during tamping operation is not necessarily made from hardened steel but can be made from for example a less expensive kind of steel. The upper tamper bar member 8' and the lower tamper bar member 8" are connected to each other by a plurality of screws 16 whereby the lower surface 23 of the upper tamper bar member 8' contacts the upper surface 24 of the lower tamper bar member 8" (see FIG. 6). Inbetween the upper tamper bar member 8' and the lower tamper bar member 8", there is arranged a heating element 17 (see FIG. 6) comprising a multi-layered structure of layers (see FIGS. 5*a* to 5*d* and FIG. 8) applied to either one of the upper surface 24 of the lower tamper bar member 8" or the lower surface 23 of the upper tamper bar member 8' by thermal spraying whereby the latter case is more preferable, since upon replacement of the lower tamper bar member 8", the heating element 17 does not have to be replaced together with it but rather remains unaffected by the replacement procedure of the lower tamper bar member 8" on the lower surface of the upper tamper bar member 8'.

At the upper surface 25 of the upper tamper bar member 8', the latter is connected to two piston rods 15 such that the upper tamper bar member 8' functions as a spacer or intermediate part between the lower tamper bar member 8" and the piston rod 15. The piston rod 15, at its upper end, has connecting means 26 for connecting the tamper bar 8 to a part of a drive means not shown here. In particular, an exciter shaft may be supported in the connecting means 26 of the piston rods 15.

Figure 4:
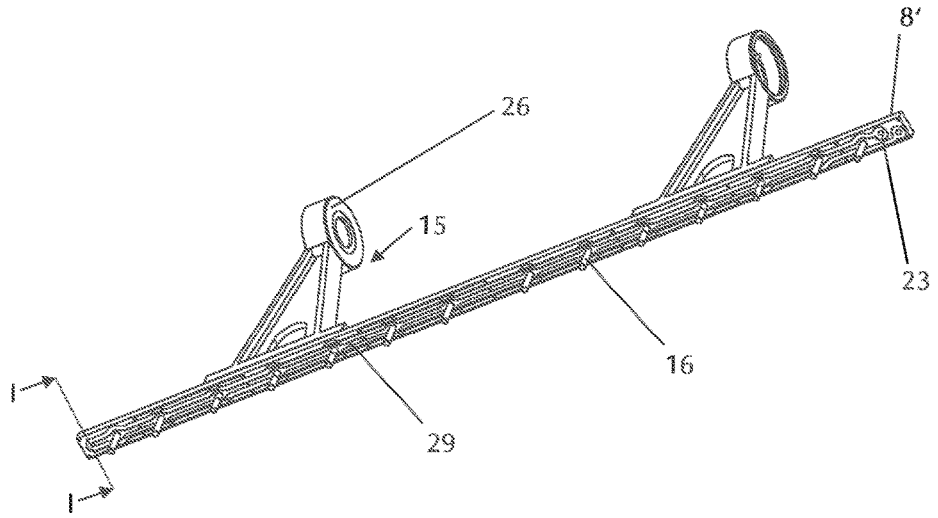
FIG. 4 is a perspective view of the piston rod and the upper tamper bar member of the tamper bar shown in FIG. 3.

FIG. 4 is a perspective view of the piston rod 15 and the upper tamper bar member 8' of the tamper bar 8 shown in FIG. 3, disassembled from the lower tamper bar member 8" which is not shown here. As can be seen, the lower surface 23 of the upper tamper bar member 8' is provided with a groove 29 in which the heating layers 18 of the heating element 17 are applied by thermal spraying. Further, a plurality of screws 17 can be seen running through the upper tamper bar member 8' and projecting from its lower surface 23. In an assembled state, the screws 17 are in engagement with corresponding holes (not shown) provided in the upper surface 24 of the lower tamper bar member 8" at corresponding positions.

Figure 5A:
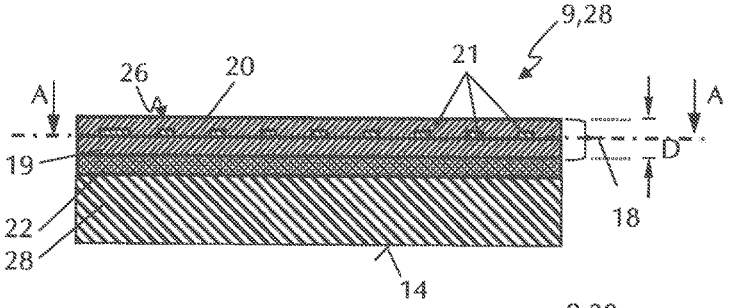
FIG. 5*a* is a vertical cross-sectional view of a metallic support plate of a tamper bar.

As shown in FIG. 5*a*, the first heating layer 18 of the heating element 17 applied to the tamper bar 8 is composed of a total of three layers including an electrically insulating layer 19, a sealing layer 20, and a metallic strip conductor 21. Each of these layers has been applied successively and on top of each other by thermal spraying. An intermediate anchor layer 22 is, likewise by thermal spraying, optionally applied directly to the lower surface 23 of the upper tamper bar member 8'. The metallic strip conductor 21 is applied to the surface of the insulating layer 19 facing the sealing layer 20 and is covered by the sealing layer 20. The metallic strip conductor 21 serves as an electrical heating member to heat the sealing layer 20 and forms part of an electric heating circuit which is connected to an electrical power supply system (not shown).

The heating layer 18 can be obtained by successively applying the three layers 19, 20 and 21 by means of thermal spraying, in particular, by means of a thermal plasma spraying technique or HVOF, onto the tamper bar 8 (more specifically its metallic support plate 28, see FIG. 2*b*). Any remarks made hereinafter with reference to thermal plasma spraying is to be understood to likewise apply, within the scope of the present invention, to other thermal spraying techniques such as, in particular, HVOF. Thermal plasma spraying technique is a surface coating technology known in the industry. For this purpose in a first step, the intermediate anchor layer 22 is sprayed onto the surface of the support plate 28 following preparation of the surface by sand blasting. In particular, a defined surface roughness enables particularly stable, essentially mechanical anchoring of the optional intermediate anchor layer 22 on the support plate 28 of the tamper bar 8. Then, the insulating layer 19 is deposited onto the intermediate anchor layer 22 by thermal plasma spraying technique. Next, the strip conductor 21 is deposited on the insulating layer 19 also by thermal plasma spraying technique. Finally, the sealing layer 20 is deposited to seal the insulating layer 19 and the strip conductor 21 from the environment and, in particular, to provide mechanical protection towards the environment. In this specific exemplary embodiment, the strip conductor 21 is deposited on the insulating layer 19 and embedded in the sealing layer 20. Thus, at least three successive steps of the plasma spraying procedure are performed to obtain the heating layer 18. The sealing layer 20 and the insulating layer 19 are each composed of alumina based material, whereas the strip conductor 21 is preferably composed, for example, of a nickel-chromium alloy, or of another material composition, in particular, as described above. The heating layer 18 has a thickness "D". The single layers including the insulating layer 19 and the sealing layer 20 are substantially of the same size and of the same thickness, and strip conductor 21 can be of a substantially smaller thickness than, for example, the sealing layer 20.

Figure 5B:
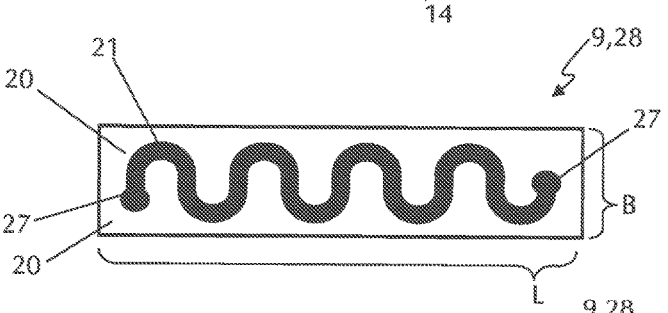
FIG. 5*b* is a horizontal cross-sectional view of the tamper bar shown in FIG. 5*a;*

FIG. 5*b* is a horizontal cross sectional view of the metallic support plate 28 of the tamper bar 8 along the line A-A in FIG. 5*a*. FIG. 5*b* illustrates that the strip conductor 21 extends in a meandrous pattern across the surface of the insulating layer 19. When implemented in practice, the strip conductor 21 is not visible on the metallic plate 28 of the tamper bar 8, as it is covered towards the top by the sealing layer 20. Thus, FIG. 5*b* shows the course of the strip conductor 21 as being underneath the sealing layer 20 merely for the purpose of clarification.

The strip conductor 21 terminates at both ends at contact points 27 that are connected to an electrical power supply system (not shown). To this end, provision is made, in particular, for contact pins or comparable connecting means, for example, to lead away from the tamper bar 8.

Figure 5C:
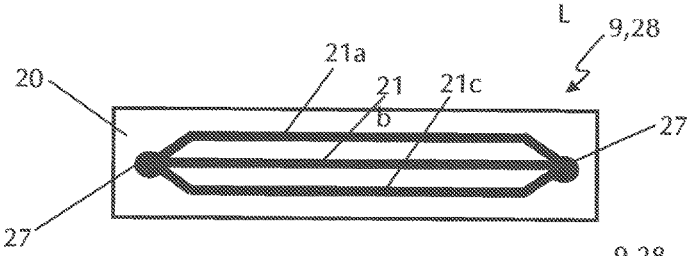
FIG. 5*c* is an alternative embodiment relating to FIG. 5*b;*
Figure 5D:
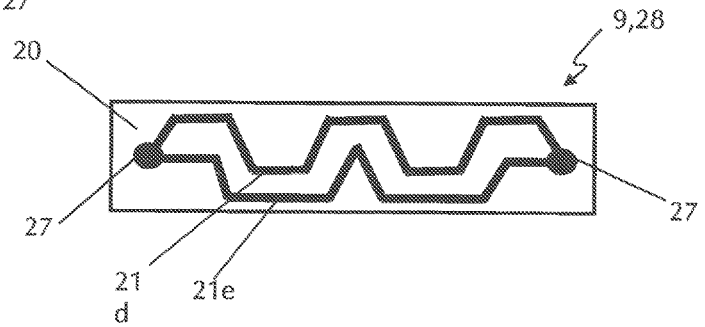
FIG. 5*d* is a further alternative embodiment relating to FIG. 5*b;*

FIGS. 5*c* and 5*d* show further exemplary embodiments of a possible run of the strip conductor. In FIG. 5*c*, the strip conductor is arranged in a linear pattern of webs across the metallic support plate 28 of the tamper bar 8 with a number of individual webs 21*a*, 21*b*, 21*c* running parallel to each other. By contrast, FIG. 5*d* shows two webs 21*d*, 21*e* of the strip conductor that are interconnected with each other. It is essential for the configuration of the strip conductor that the underside of the support plate 28 facing the paving material, apart from heating up rapidly, should also heat up at the same time over its entire surface as far as possible in order to prevent any bituminous paving material from sticking thereto.

Figure 6:
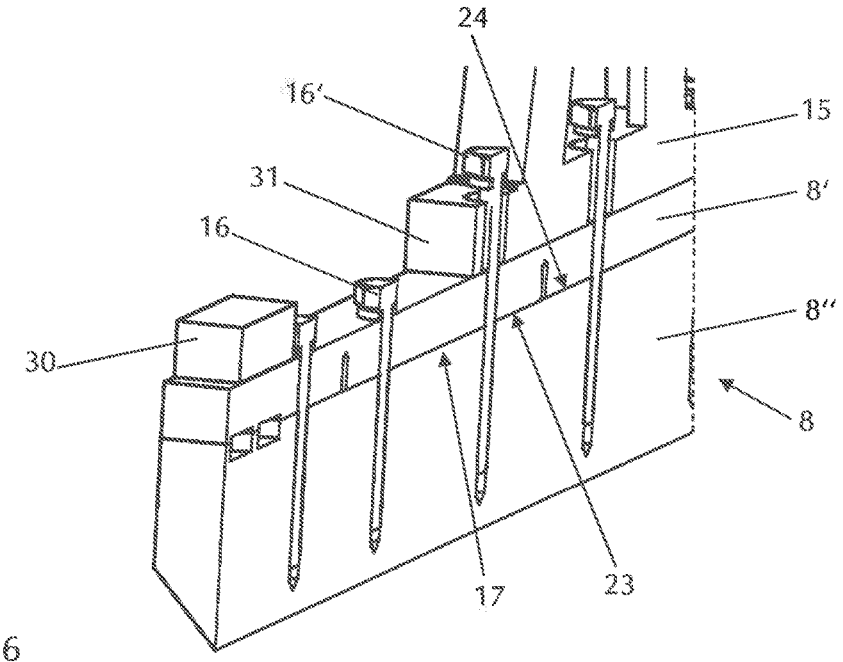
FIG. 6 is a perspective cross-sectional view of a first end portion of the tamper bar shown in FIG. 3.

FIG. 6 is a perspective cross-sectional view of a first or left hand side end portion of the tamper bar 8 shown in FIG. 3 according to which it can be seen how the screws 16 penetrating through the upper tamper bar member 8' engage the lower tamper bar member 8" in the assembled state of the tamper bar. Further, it can be seen that on the upper surface 25 of the upper tamper bar member 8', on the left hand side, a housing or cap 30 is provided in which the electrical connections can be accommodated. Also, it can be seen here that the screws 16' provided in the region of the piston rod 15 have a longer shaft than the screws 16 so as to also penetrate through a base member 31 of the piston rod 15 so as to connect the latter to the tamper bar 8.

Figure 7:
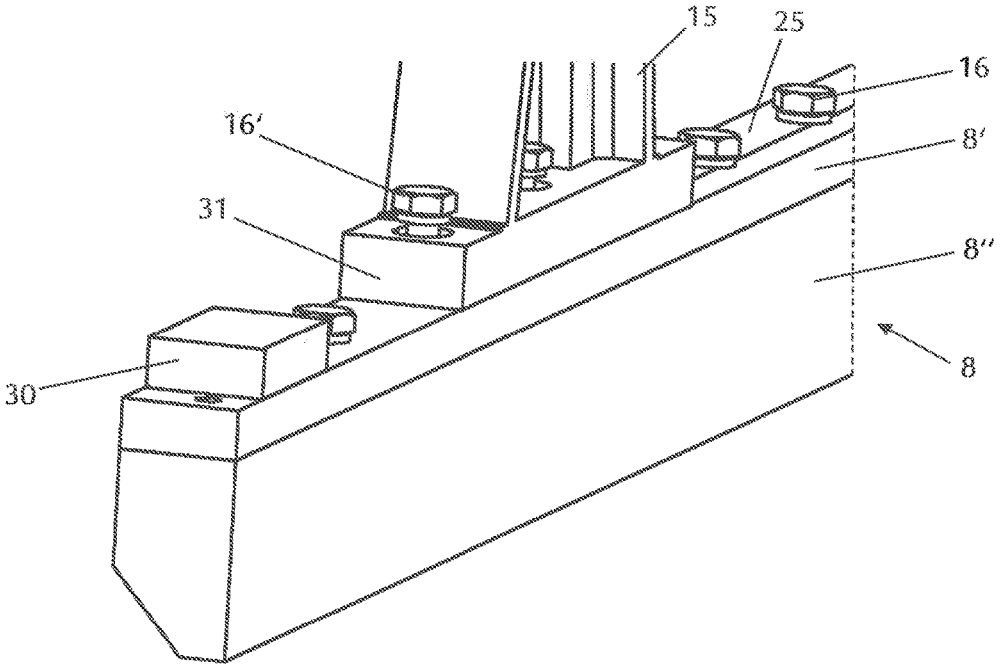
FIG. 7 is a perspective view of the first end portion of the tamper bar shown in FIG. 6.

FIG. 7 is a perspective view of the first end portion of the tamper bar 8 shown in FIG. 6. As can be seen in the assembled state, the tamper bar 8 forms a compact structure whereby if the lower tamper bar member 8" has to be replaced, the upper tamper bar member 8" comprising the heating element 17 remains connected to the piston rod 15 and does not have to be replaced. Further, only the lower tamper bar member 8" is made from hardened steel, reducing production costs. Also, it can be seen that the cap 30 fully protects the electrical connections of the heating element 17.

Figure 8:
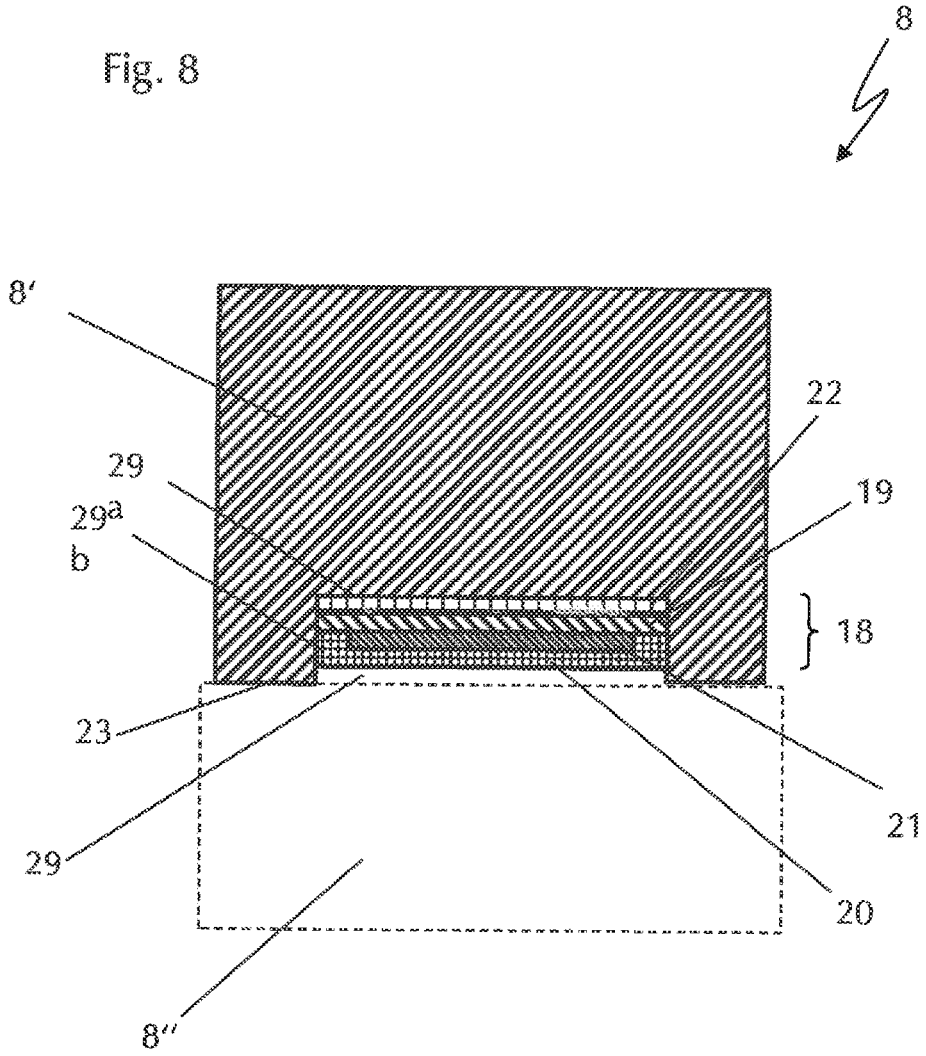
FIG. 8 is a vertical cross-sectional view of an upper tamper bar element with the heating layer being positioned in a groove.

FIG. 8 further clarifies the positioning of the heating layer 18 in the groove 29, in the shown example in the upper tamper bar 8'. FIG. 8 is a partial cross-sectional view along line I-I of FIGS. 3 and 4. The groove comprises a groove bottom 29*a* and groove side walls 29*b*, wherein the groove side walls 29*b* extend between the groove bottom 29*a* and the lower surface 23 of the upper tamper bar member 8'. As can clearly be seen, the heating layer 18 is accommodated with all of its layers within the groove 29. Thus, the heating layer 18 does not protrude over the surrounding surface of the lower surface 23 of the upper tamper bar member 8'. In the shown example, there is furthermore provided a gap 31 between the outer surface of the heating layer 18 and the upper surface of the lower tamper bar member 8". Thus, in the assembled state of the upper tamper bar member 8' and the lower tamper bar member 8", the heating layer is not directly contacting the opposite tamper bar member, in the present case the lower tamper bar member 8". It is however possible and part of the invention as well, to fill up the groove 29 up to that the heating layer is essentially flush with the lower surface 23 of the upper tamper bar 8' (per definition, the surface of the groove is not part of the lower or upper surface of the upper or lower tamper bar member 8', 8", respectively). For example the material of the outer sealing layer 20 may be used for this purpose.

What is claimed is:

1. A road finisher, comprising:

a screed plate extending at right angles to the working direction of the road finisher; and a tamper bar disposed rearwardly and/or forwardly of the screed plate in the working direction, wherein at least one electrically operated heating element is present, which is configured to heat up a heating surface facing a road subsurface, and wherein the heating element comprises a heating layer at least partially comprising a thermal spray coating obtained through thermal spraying onto a substrate surface, wherein the tamper bar is made from two parts with an upper tamper bar member and a lower tamper bar member assembled together;

wherein the upper tamper bar member has a lower surface which, in the assembled state, contacts an upper surface of the lower tamper bar member, wherein a groove is provided in the lower surface of the upper tamper bar member; and wherein the heating layer, which is multilayered comprising at least an insulating layer, a strip conductor, and a sealing layer, is accommodated in the groove.

2. The road finisher according to claim 1, wherein the substrate surface is provided by a surface of the groove in the lower surface of the upper tamper bar member.

3. The road finisher according to claim 1, wherein the thermal spray coating of the heating layer further comprises a multilayered coating, wherein each of the insulating layer, the strip conductor, and the sealing layer provide a coating layer of the multilayered coating, respectively.

4. The road finisher according to claim 1, wherein the thermal spray coating is a plasma spray coating or high velocity oxygen fuel spray coating.

5. The road finisher according to claim 1, wherein the groove, in the assembled state of the upper tamper bar member and the lower tamper bar member, provides an encapsulated cavity for the heating layer.

6. The road finisher according to claim 1, wherein the upper tamper bar member forms a spacer between a piston rod connected to an upper surface of the upper tamper bar member and the lower tamper bar member.

7. The road finisher according to claim 1, wherein the upper tamper bar member and/or the lower tamper bar member is/are made from steel.

8. The road finisher according to claim 1, wherein at least the insulating layer and/or the sealing layer are made from an alumina based material.

9. The road finisher according to claim 1, wherein the strip conductor consists substantially of nickel, chromium, or an alloy including both nickel and chromium.

10. The road finisher according to claim 6, wherein electrical connections of the heating element are provided on the upper surface of the upper tamper bar member.

11. The road finisher according to claim 1, wherein the upper tamper bar member is connected to the lower tamper bar member by fixation means.

* * * * *